US010336423B2

(12) United States Patent
Gray

(10) Patent No.: US 10,336,423 B2
(45) Date of Patent: Jul. 2, 2019

(54) TOP DOWN FURLING SYSTEM AND METHOD

(71) Applicant: NROB, LLC, Arlington, VA (US)

(72) Inventor: Brian Joseph Gray, Arlington, VA (US)

(73) Assignee: NROB, LLC, Arlington, VA (US)

( * ) Notice: Subject to any disclaimer, the term of this patent is extended or adjusted under 35 U.S.C. 154(b) by 0 days.

(21) Appl. No.: 15/807,894

(22) Filed: Nov. 9, 2017

(65) Prior Publication Data

US 2019/0135396 A1 May 9, 2019

(51) Int. Cl.
*B63H 9/04* (2006.01)
*B63H 9/10* (2006.01)

(52) U.S. Cl.
CPC ..... *B63H 9/10* (2013.01)

(58) Field of Classification Search
CPC ..... B63H 9/08; B63H 9/10; B63H 9/1021; B63H 9/1028; B63H 9/1035; B63H 9/1042; B63H 9/1078; B63H 9/1092; B63H 2009/08; B63H 2009/10; B63H 2009/1021; B63H 2009/105; B63H 2009/1057; B63H 2009/1064
USPC ..... 114/104–115
See application file for complete search history.

(56) References Cited

U.S. PATENT DOCUMENTS 5,463,970 A * 11/1995 Hartlmeier ..... B63H 9/1028 114/105
6,318,285 B1 11/2001 Hartlmeier et al.
6,895,882 B1 * 5/2005 Dahmen ..... B63H 9/1028 114/106
7,263,941 B2 * 9/2007 Greghi ..... B63H 9/1028 114/106
9,694,890 B2 * 7/2017 Hartlmeier ..... D07B 1/0673

FOREIGN PATENT DOCUMENTS

GB 2226800 A 7/1990

* cited by examiner

*Primary Examiner* — Daniel V Venne
(74) *Attorney, Agent, or Firm* — Laubscher & Laubscher, P.C.

(57) ABSTRACT

An apparatus for furling and unfurling a sail includes a housing with an upper end adapted for connection with an upper end of a sailboat mast and a lower end including a swivel, rotatable relative to the housing upper end and adapted for connection with an upper corner of a sail. Within the housing there is a motor with a clutch attached to it. When the housing upper and lower ends are connected to the top of a mast and sail, respectively, the motor rotates the swivel in a first direction to furl a sail, and when the clutch is released, the swivel is free to rotate in a second direction opposite the first direction to unfurl the sail. The housing can further include a stop mechanism which prevents the housing upper end from rotating when the swivel is rotated.

7 Claims, 5 Drawing Sheets

FIG. 1
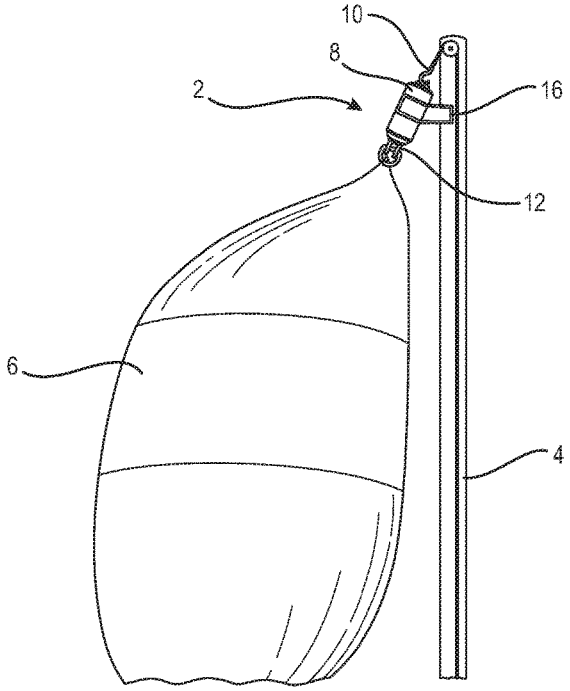
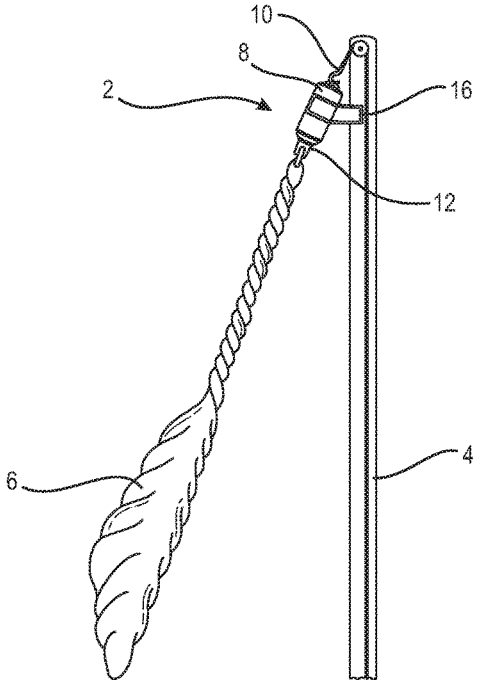
FIG. 2

TOP DOWN FURLING SYSTEM AND METHOD

BACKGROUND OF THE INVENTION

The present invention relates to furling and unfurling sails. The improvements detailed herein make it easier and more convenient to furl and unfurl a sail, such as an asymmetrical spinnaker.

Sailboats often include multiple sails used for different reasons, depending on wind conditions. Of these sails, a spinnaker and jib are found at the bow of the sail, and are meant to catch wind coming from the rear and side of the boat, respectively. Spinnaker can be either symmetrical or asymmetrical. Symmetrical spinnakers are more often used for sailing in a downwind direction, while asymmetrical spinnakers are often used for sailing with crosswinds known as reaching.

Asymmetrical spinnakers have been used more frequently in recent decades, as sailors have discovered the benefit of sailing with crosswind rather than downwind. Crosswind sailing includes a less direct sailing line and more frequent jibing, as compared to downwind sailing, and thus requires different methods and equipment. Due to this increased popularity and use, asymmetrical spinnakers have received increased attention and numerous improvements in equipment and methods including the use of top down furling systems.

BRIEF DESCRIPTION OF THE PRIOR ART

The Hartlmeier U.S. Pat. Nos. 5,463,970 and 6,318,285 disclose top down furling systems and methods known in the art. These systems include a rotary device, such as a drum, a swivel, a cable for transmitting torque, a rope, and a sail. The rotary device is attached to the bow of the sailboat and the swivel is attached to a halyard. The rope connects with the rotary device and causes the device to rotate in one of two directions. The cable and sail are attached to the rotary device at one end and the swivel at another end. The sail furls about the torsion cable.

Once installed, the rope is pulled in one direction to cause the rotary device to rotate and transmit torque from the cable to the swivel. The cable must be taught so that the cable itself does not spin and torque is transmitted. The sail then begins to wind, or furl, about the cable, starting from the top closest to the swivel, and working its way down until the entire sail is furled. Depending on the direction of rotation, the rotary device will cause the swivel to furl or unfurl the sail.

The rotary device and attached rope can be operated manually or with a motor. The Wilson GB Patent Application No. 2,226,800 discloses a demountable powered furling system that can be attached to the drum of a boat and can be powered by a hydraulic or electric motor. The system attaches to existing furling gear and causes it to turn and thus furl the sail.

Top down furling devices make handling asymmetrical spinnakers an easier task, allowing for a smaller crew. However, these systems provide some challenges. For the cable to properly transmit torque, the rope and luff must be properly tensioned. A cable that is too loose will result in an improperly furled sail. In addition, the cables used with these systems are costly, resulting in an overall expensive top down furling system.

SUMMARY OF THE INVENTION

Accordingly, it is an object of the present invention to provide an apparatus for furling and unfurling a sail from the top down that includes a motor located proximate to the top of a mast and that does not include a torsion cable. The apparatus includes a housing with an upper end adapted for connection with an upper end of a sailboat mast and a lower end including a swivel, rotatable relative to the housing upper end and adapted for connection with an upper corner of a sail. Within the housing there is provided a motor with a clutch attached to the motor. When the housing upper and lower ends are connected to the top of a mast and corner of a sail, respectively, the motor rotates the swivel in a first direction to furl a sail, and when the clutch is released, the swivel is free to rotate in a second direction opposite the first direction to unfurl the sail. The housing further includes a stop mechanism which prevents the housing upper end from rotating when the swivel is rotated.

In a preferred embodiment, the stop mechanism is an arm attached to the upper end of the housing and extending outwardly to act as an abutment with a sailboat mast or furled jib.

It is a further object of the present invention to provide a method for furling and unfurling a sail which includes the steps of attaching the upper end of a housing containing a motor to the top of a sailboat mast, attaching a lower end of the housing to an upper corner of a sail, and operating the motor to rotate the housing lower end in a first direction relative to the upper end to furl the sail. A clutch that is within the housing and connected with the motor can be released, allowing the housing lower end to rotate in a second direction opposite the first direction to unfurl the sail.

BRIEF DESCRIPTION OF THE FIGURES

Other objects and advantages of the disclosure will become apparent from a study of the following specification when viewed in the light of the accompanying drawing, in which:

FIGS. 1 and 2 are schematic representations of the apparatus of the present invention showing a sail in unfurled and furled conditions, respectively;

DETAILED DESCRIPTION

Figure 3:
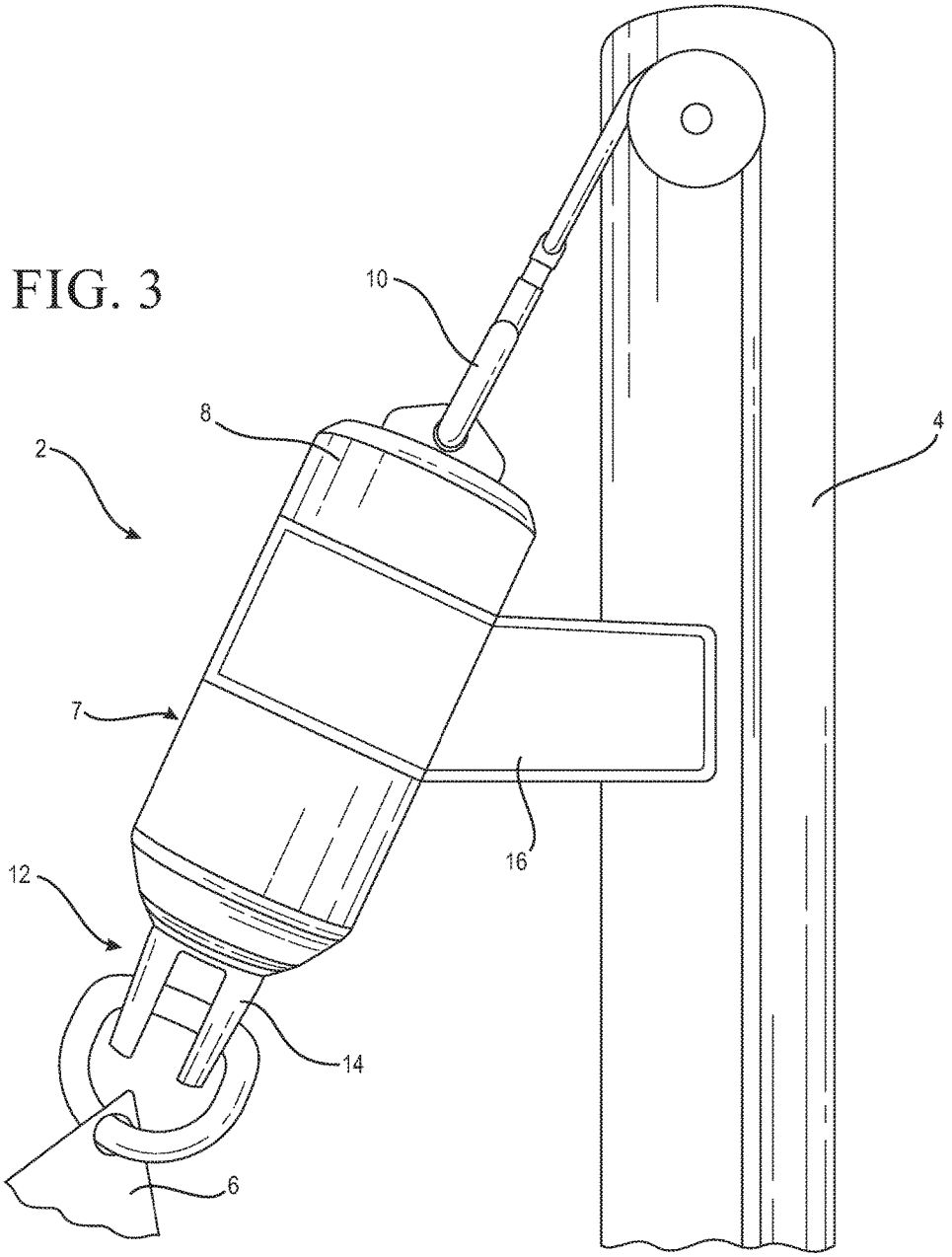
FIG. 3 is a detailed view of the upper portion of FIG. 1 showing the furling device attached to a sailboat mast and sail.

Referring first to FIGS. 1-3, the furling and unfurling device 2 according to the invention is connected with a sailboat mast 4 and a sail 6. The device includes a housing 7 having an upper end 8 attached to a halyard 10. The lower end 12 of the housing 7 includes a swivel 14 attached to the top corner of a sail 6. Another corner of the sail is attached to the bow of the sailboat, and a third corner of the sail is attached to a rope as is known in the art. The halyard 10 is hoisted to the top of the sailboat mast 4, along with the housing 7 and furled sail 6, as shown in FIG. 2. The housing preferably includes a stop mechanism such as an arm or rod 16 which extends laterally and abuts against the mast to prevent the upper end 8 of the housing from rotating while the swivel 14 rotates.

Once hoisted, the sail is furled or unfurled. To furl the sail, the clutch 20 and motor 18 are engaged causing the swivel 14 to rotate in a first direction. Rotating the swivel transmits torque to the sail 6 causing it to furl about itself. Preferably, the swivel will rotate at 120 rpms and the torque will be approximately 100 nm.

To unfurl the sail, the clutch 20 is released and a rope (not shown) that is attached to a corner of the sail 6 is pulled, causing the swivel 14 to rotate in a direction opposite the first direction and causing the sail to unfurl.

When not in use, the halyard 10, furling device 2 and sail 6 can be lowered, and the device easily removed from the halyard and sail by connections 22 at its upper and lower ends.

Referring now to FIGS. 4-7, the housing 7 will be further described. The interior upper end 8 of the housing contains a power source 24 connected with a mounting plate 26 which is connected with a motor 18. A gear box 28 is connected between the motor and with a clutch 20. The clutch is connected with a bearing 30 which in turn is connected with and drives the swivel 14 of the housing lower end 12. In a preferred embodiment, the motor is brushless and drives a two-level reduction gear box.

Figure 4:
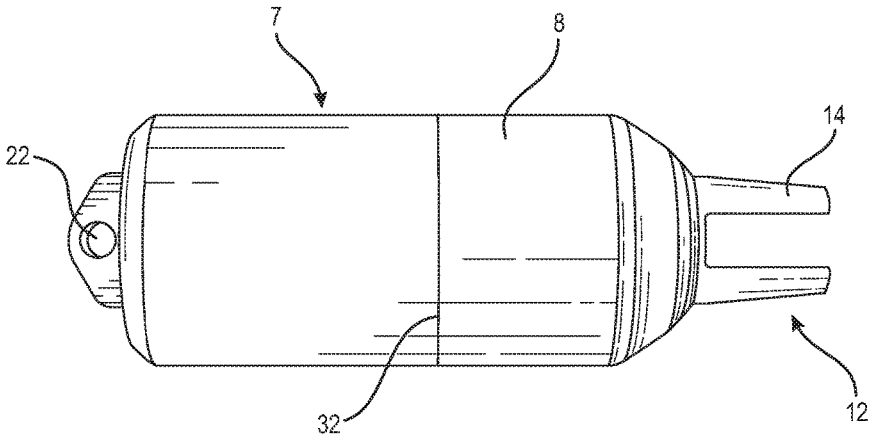
FIG. 4 is a front plan view of the furling device of FIG. 3.
Figure 5:
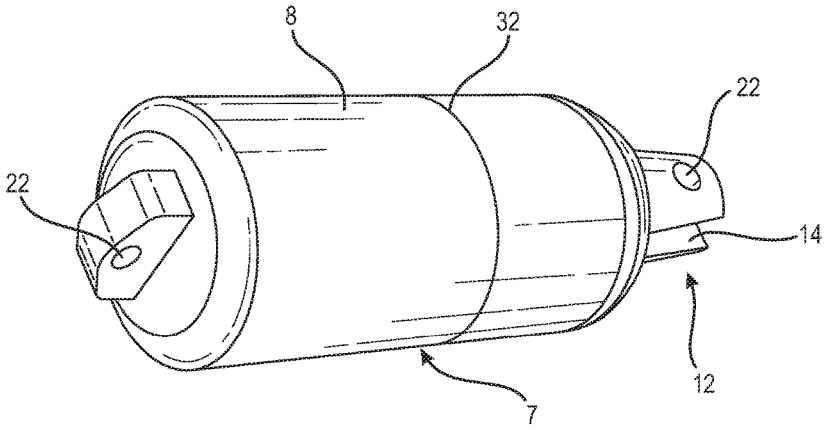
FIG. 5 is a perspective view of the furling device.
Figure 6:
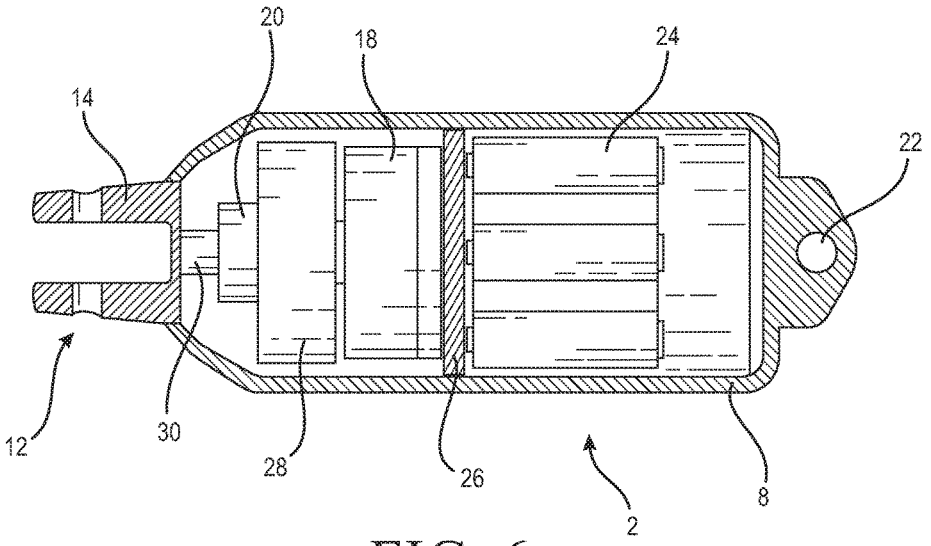
FIG. 6 is a cross-section of the apparatus disclosed herein.
Figure 7:
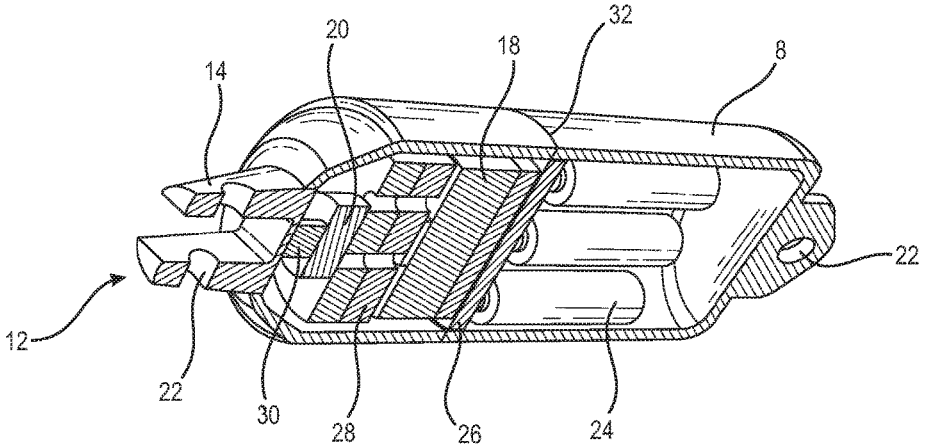
FIG. 7 is a cutaway perspective view of the furling device.

The power source 24 includes an electric, rechargeable battery. However other power sources are feasible. As shown in FIGS. 4 and 5, the upper end 10 of the housing can be separated at a central connection 32, allowing the upper end 10 to separate into two pieces and the inner power source and motor to be accessed for maintenance, recharging or replacement.

The bearing 30 is a one-way bearing. When the clutch 20 is engaged, the bearing 30 prevents the swivel 14 from rotating in a direction that will unfurl the sail. Once the clutch is released, the swivel is free to rotate, and a rope is pulled to unfurl the sail. The sail can then be furled by engaging the clutch 20 and motor 18 and rotating the swivel 14.

The motor 18 and clutch 20 are controlled by a remote control device (not shown). This allows the sail to be furled and unfurled from a remote location, for instance the cockpit, and with minimal crew. The ease with which the clutch and motor can be engaged also allows for simple switching between furling and unfurling of a sail.

In a preferred embodiment, the housing is waterproof.

Figure 8:
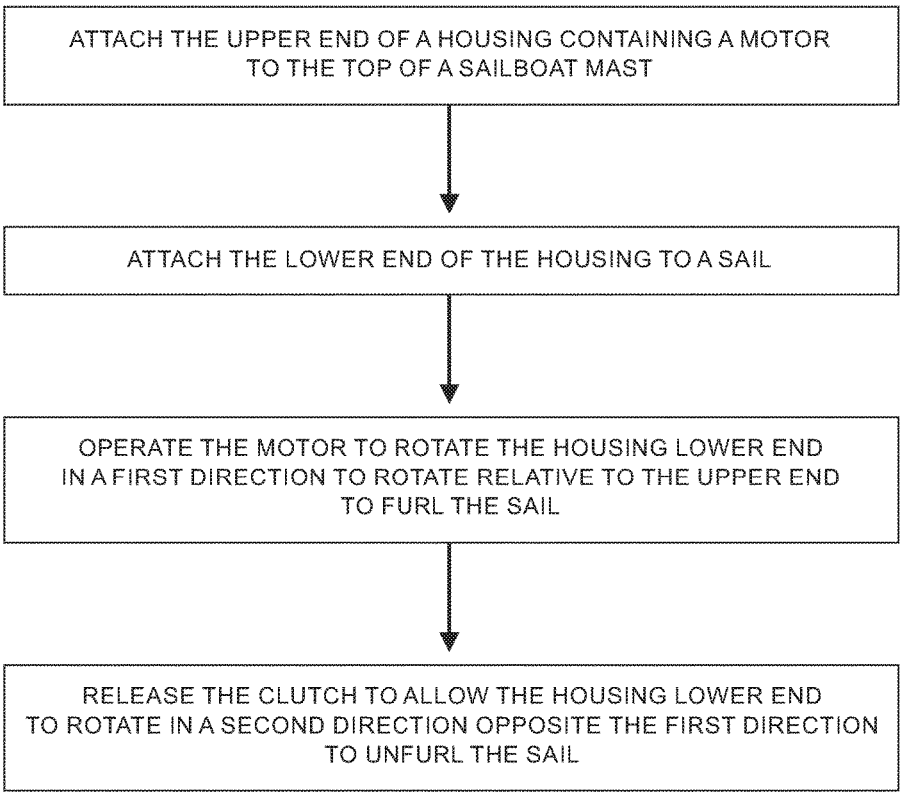
FIG. 8 is a flow chart of the steps for furling and unfurling according to the invention.

Referring now to FIG. 8, a flow chart show the method steps for furling or unfurling a sail according to the invention. First, the upper end of the motorized furling and unfurling device is attached to the top of a sailboat, preferably by way of a hoisted halyard. The lower end of the housing of the device is attached to the upper corner of a sail. The lower corner of the sail is attached to the bow of the boat. Once the housing is attached and hoisted to the top of the mast, the motor can be operated to rotate the housing lower end in a first direction relative to the upper end to furl the sail. The housing can also contain a clutch which is attached to the motor, which when released will allow the housing lower end to be free to rotate in a direction opposite the first direction to allow the sail to be unfurled.

While the preferred forms and embodiments of the invention have been illustrated and described, it will be appreciated by those of ordinary skill in the art that various changes and modifications may be made without deviating from the inventive concepts set forth above.

What is claimed is:

1. Apparatus for furling and unfurling a sail, comprising:

(a) a housing having an upper end containing an opening for connection with an upper end of a sailboat mast and a lower end including a swivel rotatable relative to said upper end and containing an opening for connection with an upper corner of a sail;

(b) a motor arranged within said housing; and (c) a clutch arranged within said housing and connected with said motor, whereby when said housing upper and lower ends are connected to a top of a mast and sail, respectively, said motor rotates said swivel in a first direction to furl the sail, and when said clutch is released, said swivel is free to rotate in a second direction opposite said first direction to unfurl the sail.

2. Apparatus as defined in claim 1, wherein said housing includes a stop mechanism for preventing said housing upper end from rotating when said swivel is rotated.

3. Apparatus as defined in claim 2, wherein said stop mechanism is an abutment contacting one of the mast and a furled jib.

4. Apparatus as defined in claim 3, and further comprising a one-way bearing arranged within said housing and connected with said clutch allowing said swivel to rotate in said first direction.

5. Apparatus as defined in claim 1, and further comprising a remote controller for operating said clutch and said motor.

6. Apparatus as defined in claim 1, wherein said motor comprises an electric motor.

7. Apparatus as defined in claim 1, and further comprising a battery connected with said motor.

* * * * *